US007796927B2

(12) United States Patent
Ishida

(10) Patent No.: US 7,796,927 B2
(45) Date of Patent: Sep. 14, 2010

(54) COLOR IMAGE FORMING APPARATUS CAPABLE OF SUPPRESSING MIXTURE OF COLORS AND SCATTERING OF TONER

(75) Inventor: Yoshiku Ishida, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/574,074

(22) Filed: Oct. 6, 2009

(65) Prior Publication Data

US 2010/0021215 A1 Jan. 28, 2010

Related U.S. Application Data

(62) Division of application No. 11/468,159, filed on Aug. 29, 2006, now Pat. No. 7,639,975.

(30) Foreign Application Priority Data

Sep. 12, 2005 (JP) ..... 2005-263130

(51) Int. Cl.
*G03G 15/01* (2006.01)

(52) U.S. Cl. ..... 399/299; 399/302

(58) Field of Classification Search ..... 399/298, 399/299, 302, 303, 313
See application file for complete search history.

(56) References Cited

U.S. PATENT DOCUMENTS

| | | | | |
|---|---|---|---|---|
| 5,778,291 | A | 7/1998 | Okubo et al. | |
| 6,134,415 | A | 10/2000 | Iwakura et al. | |
| 6,975,828 | B2 | 12/2005 | Bessho et al. | |
| 7,010,237 | B2 | 3/2006 | Suzuki et al. | |
| 7,013,095 | B2 | 3/2006 | Ishida | |
| 7,027,746 | B2 | 4/2006 | Suzuki et al. | |
| 7,164,868 | B2 | 1/2007 | Ishida | |
| 7,215,914 | B2 | 5/2007 | Murakami et al. | |
| 7,483,657 | B2 | 1/2009 | Ishida | |
| 7,536,120 | B2 | 5/2009 | Ishida | |
| 7,639,975 | B2 * | 12/2009 | Ishida | 399/299 |
| 2006/0159474 | A1 | 7/2006 | Suzuki et al. | |

FOREIGN PATENT DOCUMENTS

| | | |
|---|---|---|
| JP | 08-137174 | 5/1996 |
| JP | 09-152791 | 6/1997 |
| JP | 2000-315023 | 11/2000 |

* cited by examiner

*Primary Examiner*—William J Royer
(74) *Attorney, Agent, or Firm*—Fitzpatrick, Cella, Harper & Scinto

(57) ABSTRACT

A color image forming apparatus comprising: a first development device which develops an electrostatic image on a first image bearing member with toner of color other than black; a first transfer member which forms a nip portion for nipping an image receiving member with the first image bearing member; a second development device which develops an electrostatic image on a second bearing member with black toner so as to form a toner image and collects the toner on the second image bearing member; and a second transfer member which forms a nip portion for nipping the image receiving member with respect to the second image bearing member and transfers the toner image on the second image bearing member electrostatically to the image receiving member, wherein the position of the second transfer member to the second image bearing member in the moving direction of the image receiving member is in the downstream side relative to the position of the first image bearing member of the first transfer member.

12 Claims, 7 Drawing Sheets

COLOR IMAGE FORMING APPARATUS CAPABLE OF SUPPRESSING MIXTURE OF COLORS AND SCATTERING OF TONER

This application is a divisional of U.S. patent application Ser. No. 11/468,159, filed Aug. 29, 2006.

BACKGROUND OF THE INVENTION

1. Field of the Invention

The present invention relates to a color image forming apparatus using a so-called cleaner free system for collecting toner on an image bearing member with a development device.

2. Description of the Related Art

In recent years, image forming apparatus using a cleaner free system for collecting toner on an image bearing member with a development device has attracted public attention as a means for reducing waste. According to Japanese Patent Application Laid-Open NO. 8-137174, a plurality of image forming stations using the cleaner free system are provided. In each station, a toner image formed on the image bearing member is transferred to an intermediate transfer member electrostatically by a transfer member so as to form a color image.

However, in the aforementioned image forming apparatus, "scattering of toner" and "mixture of colors", which may cause faults in images, are in the relation of tradeoff in a relative relation between the transfer member and the image bearing member in the moving direction of an intermediate transfer member (image receiving member). The "mixture of colors" means a phenomenon that toner of another color is mixed into a development device. The "mixture of colors" is generated when a toner image transferred in an image forming station on an upstream side is transferred inversely to the image bearing member when it passes an image forming station on a downstream side. The "scattering of toner" means a phenomenon that toner is scattered around its original character proportion. If the transfer member is provided on the downstream side in the moving direction of the intermediate transfer member, the mixture of colors worsens although the "scattering of toner" is suppressed. To the contrary, if the transfer member is provided on the upstream side, the "scattering of toner" worsens although the mixture of colors is suppressed.

The image forming apparatus using the cleaner free system cannot suppress the mixture of colors and the scattering of toner.

SUMMARY OF THE INVENTION

An object of the present invention is to suppress the "mixture of colors" and "scattering of toner" in a color image forming apparatus using a cleaner free system.

Another object of the present invention is to provide a color image forming apparatus including: a first development device which develops an electrostatic image on a first image bearing member with toner of color other than black so as to form a toner image and collects toner on the first image bearing member; an image receiving member to which the toner image is transferred; a first transfer member which forms a nip portion for nipping the image receiving member with the first image bearing member and transfers the toner image on the first image bearing member electrostatically to the image receiving member; a second development device which develops an electrostatic image on a second image bearing member with black toner so as to form a toner image and collects the toner on the second image bearing member; and a second transfer member which forms a nip portion for nipping the image receiving member with the second image bearing member and transfers the toner image on the second image bearing member electrostatically to the image receiving member, wherein the position of the second transfer member to the second image bearing member in the moving direction of the image receiving member is on the downstream side of the position to the first image bearing member of the first transfer member.

Still another object of the present invention is to provide a color image forming apparatus including: a recording material conveying member on which a toner image is transferred to a conveyed recording material; a first development device which develops an electrostatic image on a first image bearing member with toner of color other than black so as to form a toner image and collect toner on the first image bearing member; a first transfer member which forms a nip portion for nipping the recording material with the first image bearing member and transfers the toner image on the first image bearing member electrostatically to the recording material; a second development device which develops an electrostatic image on a second image bearing member with black toner so as to form a toner image and collects the toner on the second image bearing member; and a second transfer member which forms a nip portion for nipping the recording material with the second image bearing member and transfers the toner image on the second image bearing member electrostatically to the recording material, wherein the position of the second transfer member to the second image bearing member in the moving direction of the recording material is on the downstream side relative to the position of the first image bearing member of the first transfer member.

DESCRIPTION OF THE EMBODIMENTS

According to the present invention, the position of a transfer member for a black toner image in which "mixture of colors" does not occur easily although "scattering of toner" is easy to recognize is set to a position capable of suppressing the "scattering of toner". Further, the position of a transfer member for another toner image of color other than black in which the scattering of toner is hard to see although the mixture of colors is easy to see is set to a position capable of suppressing the mixture of colors. In this way, the scattering of toner and mixture of toners can be suppressed.

Next, an image forming apparatus of an embodiment of the present invention will be described in detail with reference to the accompanying drawings.

First Embodiment

Figure 1:
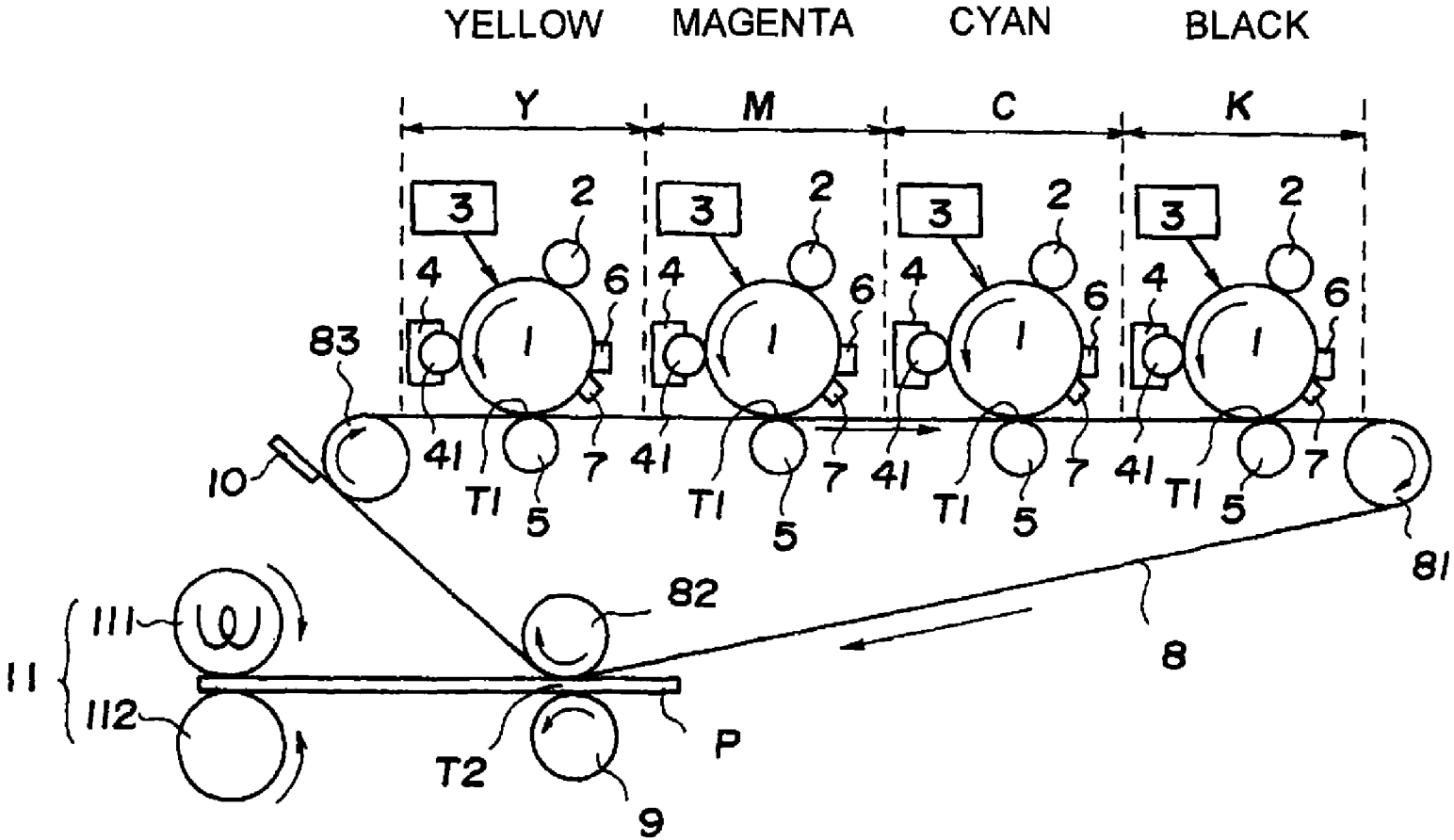
FIG. 1 is a longitudinal sectional view showing the schematic structure of an image forming apparatus according to a first embodiment.

FIG. 1 is an entire schematic explanatory diagram of the image forming apparatus of the first embodiment. First, the entire structure of the image forming apparatus will be described with reference to FIG. 1.

(Entire Structure of Image Forming Apparatus)

The image forming apparatus of this embodiment is a full-color image forming apparatus free of cleaners in which an image is transferred primarily to an intermediate transfer member as a transfer object body and then the transferred image is transferred secondarily to a recording material so as to form a final image.

The image forming apparatus shown in FIG. 1 comprises four image formation devices for forming toner images of different colors, more specifically, image formation devices Y, M, C, K for forming a yellow toner image, a magenta toner image, a cyan toner image and a black toner image respectively. These image formation devices Y, M, C, K have the same electronic photographic process configuration except that each toner is different.

That is, these image formation devices Y, M, C, K form electrostatic latent image by charging the surface of an image bearing member 1 uniformly with a charging means 2 and then irradiating the image bearing member 1 with light corresponding to an image signal with an exposure means 3. The latent image is made a visible image by developing with toner by a development means 4 and the toner image is transferred primarily to an intermediate transfer belt 8 as an intermediate transfer member (image receiving member) by applying a bias to a transfer member 5. In the image forming apparatus shown in FIG. 1, the toner images are transferred to the intermediate transfer belt 8 in order of yellow, magenta, cyan and black. A full color image is formed by transferring the respective toner images of yellow, magenta, cyan and black to the intermediate transfer belt 8 so that they are overlaid. Then, the toner image is transferred secondarily to a conveyed recording material P by applying a bias to a secondary transfer means 9. After that, the recording material P is conveyed to a fixing means 11 and heated under pressure so as to fix the toner image onto the recording material P and after that, the recording material P is discharged out. On the other hand, toner left on the image bearing member 1 without being transferred completely when the toner image is transferred primarily from the image bearing member 1 to the intermediate transfer belt 8 is collected by the development means 4.

The respective components of the image formation devices Y, M, C and K of this embodiment will be described in detail.

In each image formation device Y, M, C, K, its drum-type electrophotographic photosensitive drum (hereinafter referred to as a photosensitive member) as the image bearing member 1 is rotated in the direction of an arrow (counterclockwise direction) in FIG. 1 by a drive means (not shown). The photosensitive member 1 is formed by providing a photoconductive layer on a conductive base layer and an organic photoconductor (OPC), an amorphous silicon photoconductor, a selenium photoconductor or the like may be used. In the meantime, according to this embodiment, a negatively-charged photoconductor (OPC) is used.

The charging means 2 charges the surface of the rotating photosensitive member 1 uniformly with a predetermined polarity and potential. As the charging means 2, a corona charger, a charging roller, a magnetic brush or the like may be used.

According to this embodiment, a contact charging type charging roller 2 is used. The charging roller 2 makes contact with the photosensitive member 1 under a predetermined pressure with its metal core pressed toward the photosensitive member 1 by a pressurizing means (not shown) and is rotated with a rotation of the photosensitive member 1. Further, a charging bias in which a DC voltage of −500 V and an AC voltage of 1400 Vpp with a frequency of 1000 Hz are overlapped with each other and applied to the metal core of the charging roller 2.

The charging roller 2 has a three layer structure including a carbon dispersed EPDM foamed sponge rubber lower layer, a carbon dispersed NBR rubber intermediate layer and a fluorine resin in which tin oxide and carbon are dispersed, overlaid in this order on the metal core.

The exposure means 3 is so constructed to expose the downstream side of the charging means 2 in the rotation direction of the photosensitive member 1 to light and the surface of the photosensitive member 1 charged uniformly by the charging means 2 is scanned with light so as to form an electrostatic latent image on the photosensitive member 1. As the exposure means 3, a laser scanner, an LED array or the like may be used.

According to this embodiment, a laser scanner is used. In the image forming apparatus free of a cleaner, remaining toner exists on the photosensitive member 1 at an exposure position and the photosensitive member 1 is exposed to light through the remaining toner. However, this remaining toner is no problem because the amount of the remaining toner on the photosensitive member 1 is set to an amount which does not affect formation of an electrostatic latent image by exposure to light.

The development means 4 is disposed on the downstream side of an exposure position in the rotation direction of the photosensitive member 1 and a toner image is formed on the photosensitive member 1 by developing the electrostatic latent image on the photosensitive member 1 with toner. Further, at the same time, remaining toner existing in a non-image portion of the photosensitive member 1 charged with normal charging polarity by a toner charging means 7 is collected into the development means 4 by a difference of potential between the photosensitive member 1 and a development sleeve 41 for recycle.

The image forming apparatus of this embodiment develops an electrostatic latent image on the photosensitive member 1 by reversal development with two-component nonmagnetic minus charging toner. The development sleeve 41 is disposed at a distance of closest approach of 350 μm to the photosensitive member 1 and rotated in an opposite direction of the moving direction of the photosensitive member 1 in a condition in which it opposes the photosensitive member 1. The rotation in the opposite direction is advantageous for collecting the remaining toner on the photosensitive member 1. A magnet roller (not shown) is disposed within the development sleeve 41 and two-component development agent is absorbed and held by the outer peripheral surface of the development sleeve 41 by its magnetic force. Then, with the development sleeve 41 kept in contact with the photosensitive member 1 at an opposing portion, a development bias in which a DC voltage of −350 V and an AC voltage of 1800 Vpp at a frequency of 4000 Hz are overlapped with each other and applied thereto by a power supply (not shown).

The transfer member 5 is disposed so as to oppose the photosensitive member 1 across the intermediate transfer belt 8 at a primary transfer position (nip portion) T1. A bias is applied to the transfer member 5 and a toner image on the photosensitive member 1 is transferred primarily to the intermediate transfer belt 8 by its transfer electric field. As the transfer member 5, a corona transfer charger, a transfer roller, a transfer blade, a transfer brush or the like may be used.

According to this embodiment, the transfer roller 5 is rotated with the intermediate transfer belt 8 as a transfer member. The transfer roller 5 is kept in contact with the photosensitive member 1 through the intermediate transfer belt 8 at a predetermined contact force and a toner image on the photosensitive member 1 is transferred primarily to the intermediate transfer belt 8 by a positive transfer electric field having an opposite polarity to that of the toner.

As the transfer roller 5 of this embodiment, a semiconductor transfer roller having an Asker C hardness of 10 and a roller resistance of $1\times10^6$ in which a semiconductive polyurethane foamed rubber layer is formed on a metal core is used. The roller resistance is calculated by measuring a current flowing through a metal plate when a voltage of 50 V is applied to the metal plate with a weight of 500 g loaded on each of both ends of the metal core of the transfer roller 5 so as to press a grounded metal plate through an ammeter under an environment in which the temperature is 23° C. and the relative humidity is 50% RH.

The positional relation between the transfer roller 5 and the photosensitive member 1 will be described later in detail.

Reference numeral 6 denotes a toner equalizing means, which is disposed on the downstream side of the transfer roller 5 in the rotation direction of the photosensitive member 1 and disperses the remaining toner corresponding to the image on the photosensitive member 1 after the primary transfer so as to equalize the distribution of the toner thereby preventing toner from being concentrated locally to the toner charging means 7. If the charging amount of the toner is large, the toner is neutralized. As the toner equalizing means 6, a brush, a brush roller or the like may be used. In this embodiment, a semiconductive brush 6 is connected to the ground upon usage.

Reference numeral 7 denotes the toner charging means, which charges the remaining toner on the photosensitive member 1 with a normal charging polarity which enables it to be collected by the development means 4. As the toner charging means 7, a brush, a brush roller or the like may be used.

According to this embodiment, a semiconductive brush 7 is used so as to apply a toner charging bias of −800 V by a power supply (not shown). As a consequence, adhesion of toner to the charging roller 2 can be prevented by charging the toner with a normal charging polarity.

The intermediate transfer belt 8 is stretched over a drive roller 81 and driven rollers 82, 83 and rotated in the direction of an arrow in FIG. 1 while in contact with the photosensitive member 1 of each of the image formation devices Y, M, C, K. As the intermediate transfer belt 8, resins such as polyester, fluorine resin, polyphenylene sulfide, polyamide imide, polyimide, polyether ketone, polycarbonate may be used. As for the electric resistance, preferably, its volume resistivity is $1\times10^6$-$1\times10^{13}$ Ω·cm and its surface resistivity is $1\times10^8$-$1\times10^{14}$Ω/□. More preferably, the volume resistivity is $1\times10^8$-$1\times10^{11}$ Ω·cm and the surface resistivity is $1\times10^{11}$-$1\times10^{13}$Ω/□.

In this embodiment, an endless polyimide belt 90 μm in thickness whose electric resistance is adjusted to $1\times10^{10}$ Ω·cm in volume resistivity and $1\times10^{12}$Ω/□ in surface resistivity according to a well known method is used. The electric resistance is measured in a condition of an applied voltage of 100 V and a charge time of 10 seconds using a measuring device manufactured by ADVAN TEST R8340A CORPORATION and a probe having a main electrode outer diameter of 50 mm and a guard electrode of 70 mm under an environment in which the temperature is 23° C. and the relative humidity is 50% RH.

The secondary transfer means 9 is disposed at a position opposing the driven roller 82 across the intermediate transfer belt 8 at a second transfer position T2. A toner image on the intermediate transfer belt 8 is transferred secondarily to the recording material P introduced to the second transfer position T2 at a timing of the toner image on the intermediate transfer belt 8 from a feeding portion (not shown) by a transferring electric field produced by applying a bias to the secondary transfer means 9. As the secondary transfer means 9, a corona transfer charger, a transfer roller, a transfer blade, a transfer brush or the like may be used.

In this embodiment, a secondary transfer roller is used as the secondary transfer means 9 and a toner image on the intermediate transfer belt 8 is transferred to the recording material P secondarily by a positive transfer electric field. As the secondary transfer roller 9, a semiconductive transfer roller having an Asker C hardness of 35 and a roller resistance of $1\times10^8$ in which a foamed rubber layer mainly composed of semiconductive NBR rubber and hydrin rubber is formed on a metal core is used. The roller resistance is calculated by measuring a current flowing through a metal plate when a voltage of 2000 V is applied to the metal plate with a weight of 500 g applied to both ends of the metal core of the secondary transfer roller 9 so as to press the metal core against a metal plate grounded through an ammeter under an environment in which the temperature is 23° C. and the relative humidity is 50% RH.

An intermediate belt cleaning means 10 for removing toner left on the intermediate transfer belt 8 after the toner image is transferred from the intermediate transfer belt 8 to the recording material P is provided. As the intermediate belt cleaning means 10, a cleaning roller, a cleaning blade, a cleaning web or the like may be used. In this embodiment, a cleaning blade of polyurethane having 2 mm in thickness and a durometer A hardness of 75 is used.

The fixing means 11 is constituted of a roller pair including a fixing roller 111 and a pressure roller 112, which make a pair. In these rollers, an elastic layer composed of fluorine-containing rubber, silicone rubber or the like is placed on a metallic roller and fluorine resin such as PFA, PTFE, silicone resin or the like having a high separability to toner is overlaid as a surface layer.

(Positional Relation Between Photosensitive Member and Transfer Member)

The positional relation between the photosensitive member 1 and transfer roller 5 of the image forming apparatus of this embodiment will be described.

Figure 2:
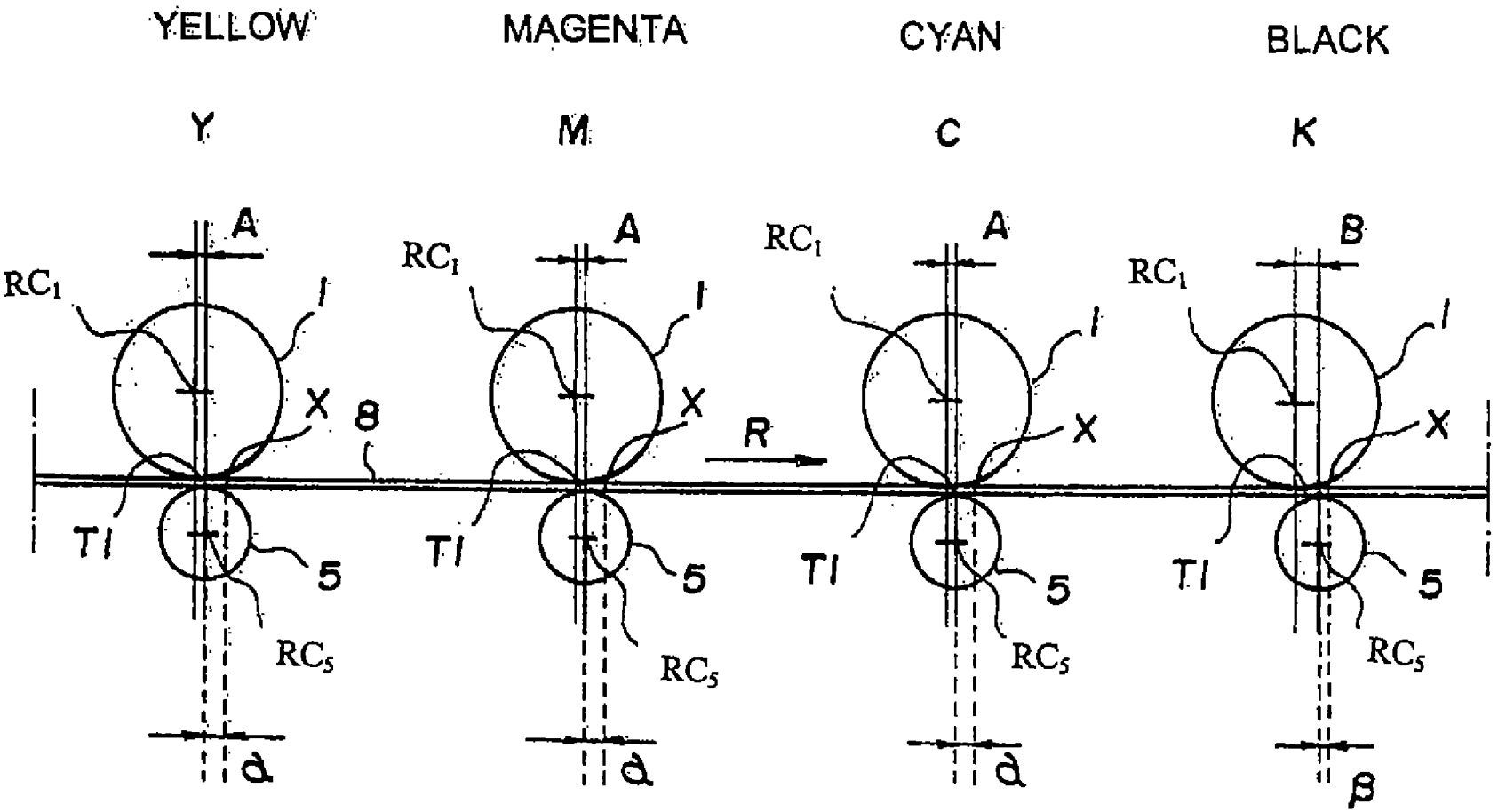
FIG. 2 is a schematic diagram showing the positional relation between a photosensitive member and a transfer roller according to a first embodiment.

FIG. 2 is a schematic explanatory diagram showing the positional relation between the photosensitive member 1 and the transfer roller 5 with respect to a moving direction R of the intermediate transfer belt 8. In the image forming apparatus of this embodiment, respective image formation devices Y, M, C, K are disposed in the order of yellow, magenta, cyan and black from the upstream side in the rotation direction of the intermediate transfer belt 8. If mixture of colors in the four colors occurs due to reversal transfer from the intermediate transfer belt 8 in the primary transfer portion to the photosensitive member 1, the color which changes most is yellow and conversely the color which changes least is black. No mixture of colors occurs in the image formation device located in the uppermost upstream side in the moving direction of the intermediate transfer belt 8. Thus, according to this embodiment, the image formation device Y for yellow which is likely to be affected by change of the color due to the mixture of colors is disposed in the uppermost upstream side.

The position of the transfer roller 5 to the photosensitive member 1 of the image formation device K for black which is affected little by change in color is disposed on the downstream side in the moving direction of the intermediate transfer belt 8 (hereinafter referred to as downstream side) with respect to the transfer rollers 5 to the photosensitive members 1 of the image formation devices M, C, Y for magenta, cyan and yellow. That is, the transfer roller 5 of the image formation device K for black is disposed on the downstream side in the rotation direction of the photosensitive member 1 with respect to the transfer rollers 5 of the image formation devices M, C, Y for magenta, cyan and yellow. In other words, relation between positions of the transfer rollers 5 of each image formation devices M, C, Y and the position of the transfer roller 5 of image formation device K is as follows. At the image formation devices M, C, Y, distance $\alpha$is defined as a distance between the transfer roller 5 and a position downstream most x in a moving direction of the intermediate transfer belt 8 in the primary transfer position T1 which contacts to the intermediate transfer belt 8. At the image formation device K, distance $\beta$is defined as a distance between the transfer roller 5 and a position downstream most x in a moving direction of the intermediate transfer belt 8 in the primary transfer position T1 which contacts to the intermediate transfer belt 8. In this definition, distance $\beta$ is shorter than distance $\alpha$. As a consequence, the scattering of toner in the image formation device for black K used most in recording of letters is reduced with respect to the scattering of toner in the image formation devices Y, M, C for the other colors, thereby improving the quality of black letters.

(Black Letter Quality and Color Change Evaluation)

A result of experiment upon evaluation of image quality when an image is formed by changing the position of a rotation center of the transfer roller 5 in the image formation device K for black to the downstream side with respect to the position of the rotation center of the photosensitive member 1 in the image forming apparatus of this embodiment will be described.

In this experiment, as for the positional relation of the transfer roller 5 to the photosensitive member 1 of each of the image formation device M for magenta and the image formation device C for cyan, the rotation center $RC_5$ of the transfer roller 5 is shifted by 1.5 mm on the downstream side (A in FIG. 2) with respect to the rotation center $RC_1$ of the photosensitive member 1 in a moving direction R of the intermediate transfer belt 8. Consequently, the scattering of toner in the image formation devices M, C for magenta and cyan is suppressed. In the meantime, the image formation device Y for yellow is arranged in the same manner as the image formation devices M, C for magenta and cyan.

In the image formation device K for black, the position of the rotation center $RC_5$ of the transfer roller 5 is shifted to the downstream side with respect to the rotation center $RC_1$ of the photosensitive member 1 relative to the respective image formation devices Y, M, C for yellow, magenta and cyan. The position of the rotation center $RC_5$ is shifted by 0.5 mm each on the downstream side in a range of 1.5-4.5 mm in the shift (B in FIG. 2).

As a transfer bias, a voltage is applied so that a current of +7 μA flowed from a power supply (not shown) to each transfer roller 5.

Figure 3:
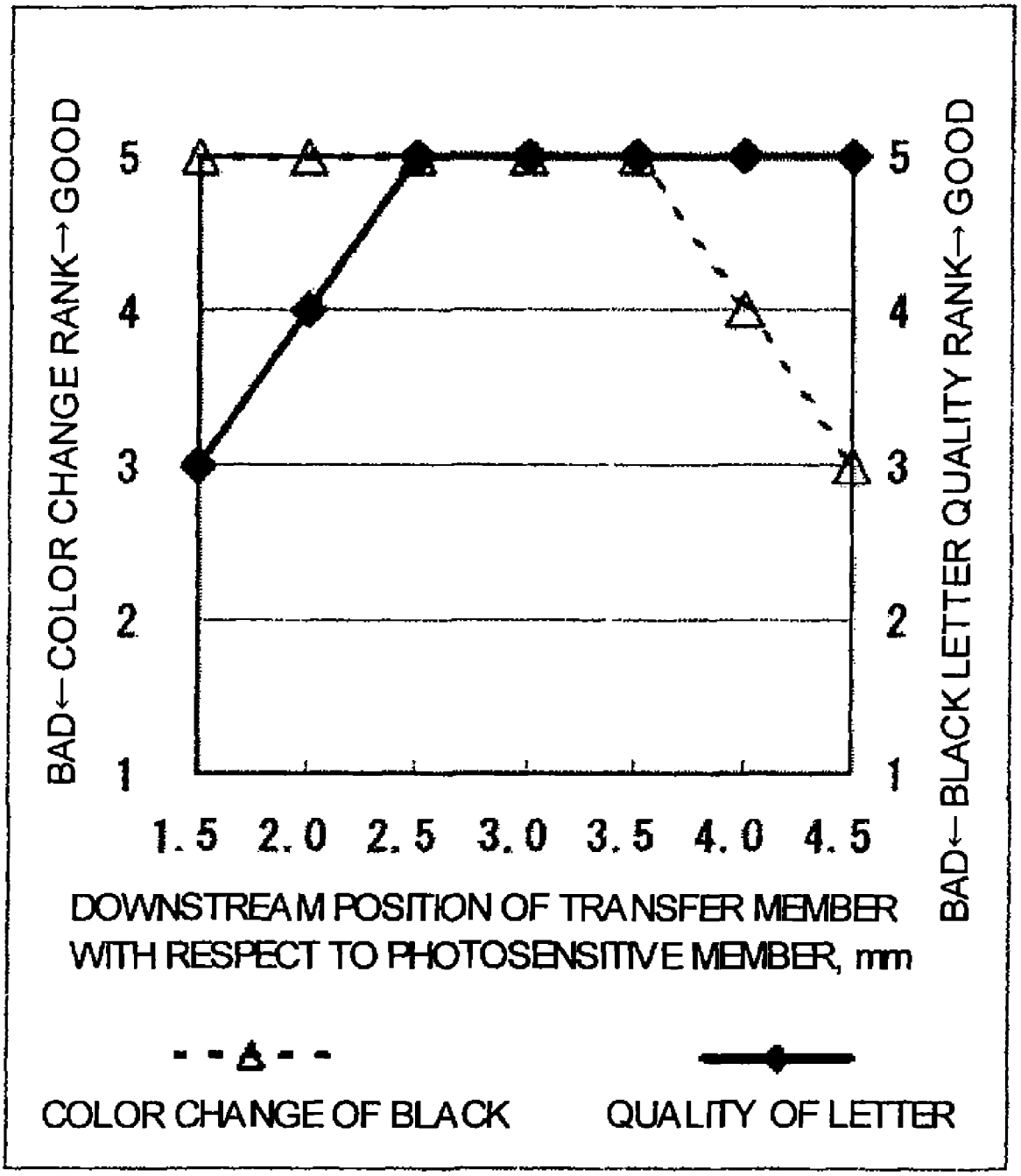
FIG. 3 is a diagram showing a result of evaluation on color change and black letter quality in an image formation device for black of the first embodiment.

Its evaluation result is shown in FIG. 3. FIG. 3 is a graph showing an evaluation on the black letter quality and change in color. The evaluation is carried out by outputting each evaluation image after 5,000 pieces of color test charts are outputted at an image ratio of 5% of each color.

As for the black letter quality, 4-point MS gothic letters are outputted and ranked in terms of readability with naked eyes. A result over rank 4 is determined to be acceptable.

As for the change in color, a black circular patch having 8 mm in outer diameter is outputted and the degree of mixture of other color toner is observed with a 25-power magnifier and its result is ranked. A result over rank 4 is determined to be acceptable.

The arrangement of the transfer roller 5 in the image formation device K for black is compared with a case where the rotation center $RC_5$ of the transfer roller 5 is set in on the downstream side of the rotation center $RC_1$ of the photosensitive member 1 by 1.5 mm like the image formation devices Y, M, C for the other colors. That is, the transfer roller 5 is disposed farther on the downstream side by 0.5-2.5 mm (2.0-4.0 mm to the photosensitive member 1). As a consequence, the change in color in an entire image is suppressed and the quality of black letter is improved, so that both are acceptable. It is assumed that a distance B between the rotation center of the photosensitive member 1 of the black image formation device K and the center position of an area in which the transfer roller 5 and the intermediate transfer belt 8 make contact with each other in the moving direction of the intermediate transfer belt 8 in FIG. 2 is L1. Then, when it is assumed that a distance A between the rotation center of the photosensitive member 1 of the cyan or magenta image formation device and the center position T1 of an area in which the transfer roller 5 and the intermediate transfer belt 8 make contact with each other is L2, it comes that 0.5 mm$\leqq$L2$\leqq$2.5 mm.

A more preferable effect is secured when the transfer roller 5 is shifted by 1.0-2.0 mm (2.5-3.5 mm to the photosensitive member 1) on the downstream side. That is, 0.5 mm$\leqq$L1-L2$\leqq$2.5 mm. A preferable amount of current flowing to the transfer roller 5 of the black image formation device K is +6 μA.

Figure 4:
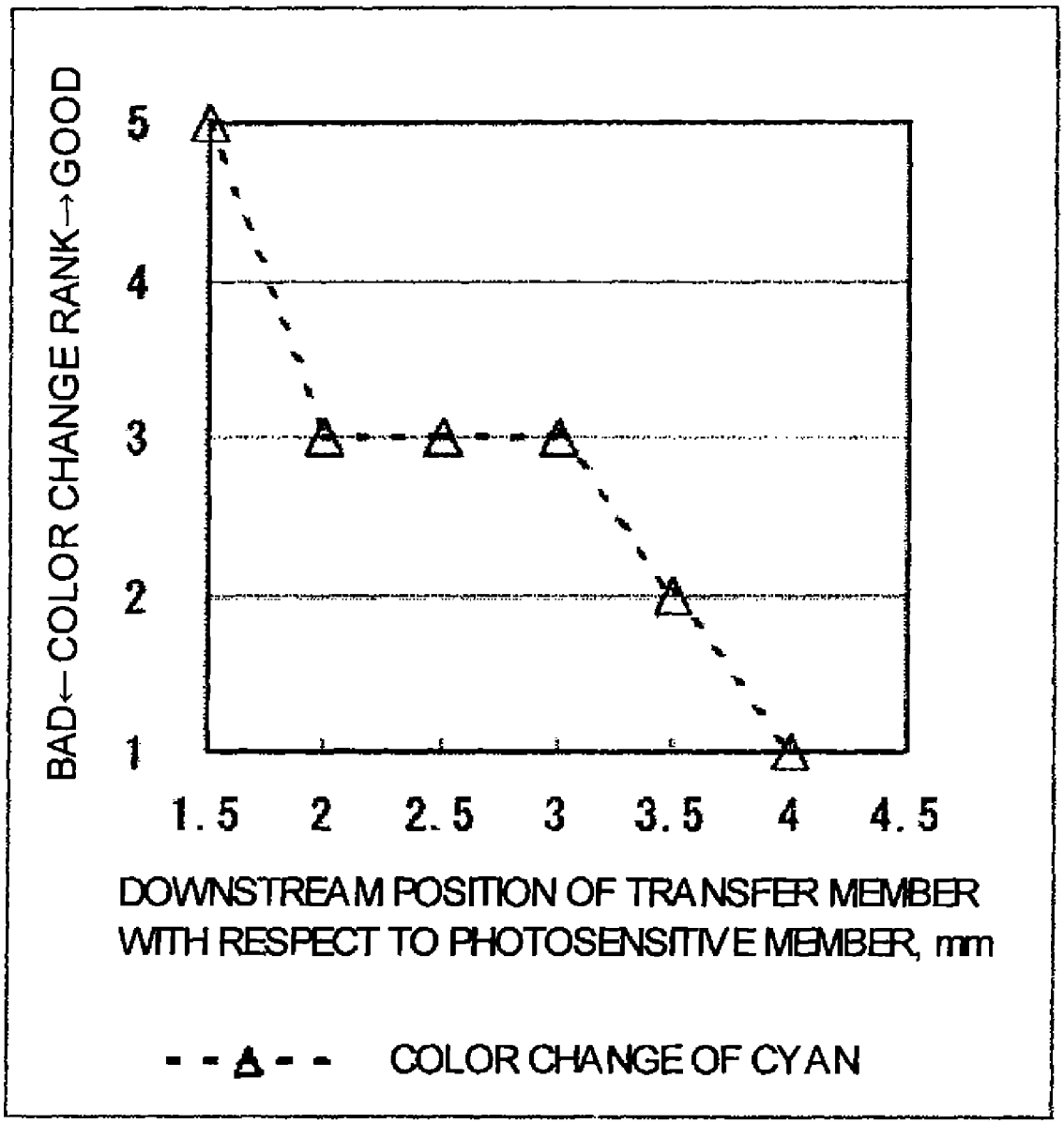
FIG. 4 is a schematic diagram showing a result of evaluation on color change in an image formation device for cyan.

FIG. 4 is a graph showing a result of evaluation carried out in the cyan image formation device C, which is the same as the evaluation described above.

The change in color in cyan toner when yellow toner or magenta toner is mixed is larger than black toner. Thus, it is difficult to set the position of the transfer roller 5 on the downstream side to the photosensitive member 1 by more than 1.5 mm because the change in color due to the mixture of colors is intensified.

It is considered that the above-described result originates from a following transfer mechanism. As the transfer roller 5 is moved on the downstream side of the photosensitive member 1, the electric field from the transfer roller 5 to the upstream side area in the vicinity of a contact area between the photosensitive member 1 and the intermediate transfer belt 8 decreases. Thus, so-called pre-transfer in which toner on the photosensitive member 1 is scattered to the intermediate transfer belt 8 by the electric field is suppressed so that the scattering of toner is reduced. As a result, the quality of the black letter is improved.

To the contrary, as the transfer roller 5 is moved on the downstream side of the photosensitive member 1, the quantity of discharge due to the electric field of the transfer roller 5 on a downstream area in the vicinity of the contact area between the photosensitive member 1 and the intermediate transfer belt 8 increases. Then, the quantity of charge of toner having a minus polarity inverted to plus polarity by discharge of a positive charge increases and this reacts with plus transfer field so that the quantity of inversely transferred toner to the photosensitive member 1 increases. As a result, the change in color becomes large.

Thus, by locating the transfer roller 5 of the image formation device K for black having a small change in color further on the downstream side to the photosensitive member 1 relative to the image formation devices Y, M, C for the other colors, an influence of the change in color can be reduced to suppress the scattering of toner. Further, the quality of letter can be improved because the black toner is a toner used frequently for recording of letters.

That is, the position of the transfer roller 5 to the photosensitive member 1 in the image formation device for a color having the smallest change in color when toner of another color is mixed is set on the downstream side relative to the position of the transfer roller 5 to the photosensitive member 1 in the image formation device for the other colors. As a result, the change in color in an entire image can be suppressed to improve the quality of letters.

The position of the transfer roller 5 to the photosensitive member 1 in the image formation device for a color having the smallest change in color may be shifted to the downstream side relative to the position of the transfer roller 5 with respect to the photosensitive member 1 in the image formation devices for the other colors except the image formation device disposed on the uppermost upstream side in the moving direction of the intermediate transfer belt 8. Thus, there is no problem if the position of the transfer roller 5 to the photosensitive member 1 is shifted largely on the downstream side in order to reduce the scattering of toner in the image formation device on the uppermost upstream side.

Second Embodiment

Figure 5:
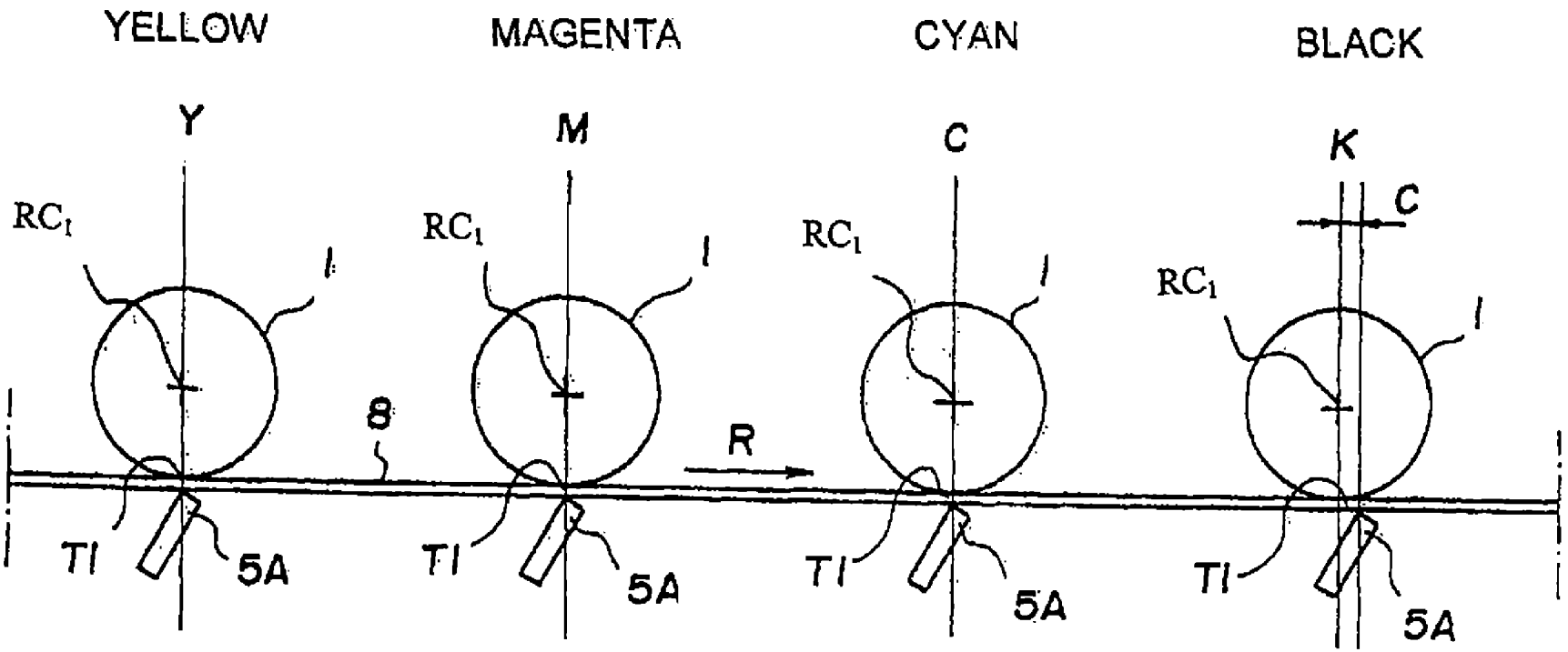
FIG. 5 is a schematic diagram showing the positional relation between a photosensitive member and a transfer blade of a second embodiment.

Next, the apparatus of a second embodiment will be described with reference to FIG. 5. Because the basic structure of the apparatus of this embodiment is equal to the first embodiment, duplicated description thereof is not repeated and a structure different from the first embodiment will be described. Like reference numerals are attached to components having the same function as the first embodiment.

This embodiment uses a blade member as a transfer member different from the first embodiment. FIG. 5 is a schematic explanatory diagram showing the positional relation between a photosensitive member 1 and a transfer blade 5A in a moving direction R of the intermediate transfer belt 8.

According to this embodiment, the transfer blade 5A as a transfer member is brought into contact with the photosensitive member 1 through the intermediate transfer belt 8 with a predetermined contact pressure so as to transfer a toner image on the photosensitive member 1 primarily to the intermediate transfer belt 8 through plus transfer electric field having an opposite polarity of the polarity of the toner.

As the transfer blade 5A, hydrin rubber coated with nylon resin is used.

The positional relation between the photosensitive member 1 and the transfer blade 5A of the magenta, cyan and yellow image formation devices M, C, Y is as follows. An edge of the transfer blade 5A in contact with the intermediate transfer belt 8 in the moving direction R of the intermediate transfer belt 8 is disposed just below the rotation center $RC_1$ of the photosensitive member 1. As a consequence, the change in color due to inversely transferred toner in the magenta, cyan image formation devices M, C is suppressed. In the meantime, the yellow image formation device Y is arranged in the same manner as the magenta, cyan image formation devices M, C.

On the other hand, in the image formation device K for black having a small change in color, the transfer blade 5A is disposed so that the edge thereof in contact with the intermediate transfer belt 8 is located on the downstream side to the rotation center $RC_1$ of the photosensitive member 1 by an amount C equal to 1.0 mm in the direction R of intermediate transfer belt 8.

As a result of executing the same evaluation as the first embodiment with the above-described image forming apparatus, the same result as the first embodiment is produced so that the quality of black letters is improved without worsening the change in color.

Third Embodiment

Next, the apparatus of a third embodiment will be described with reference to FIGS. 6, 7. Because the basic structure of the apparatus of this embodiment is also equal to the first embodiment, duplicated description thereof is not repeated and a structure different from the first embodiment will be described. Like reference numerals are attached to components having the same function as the first embodiment.

Figure 6:
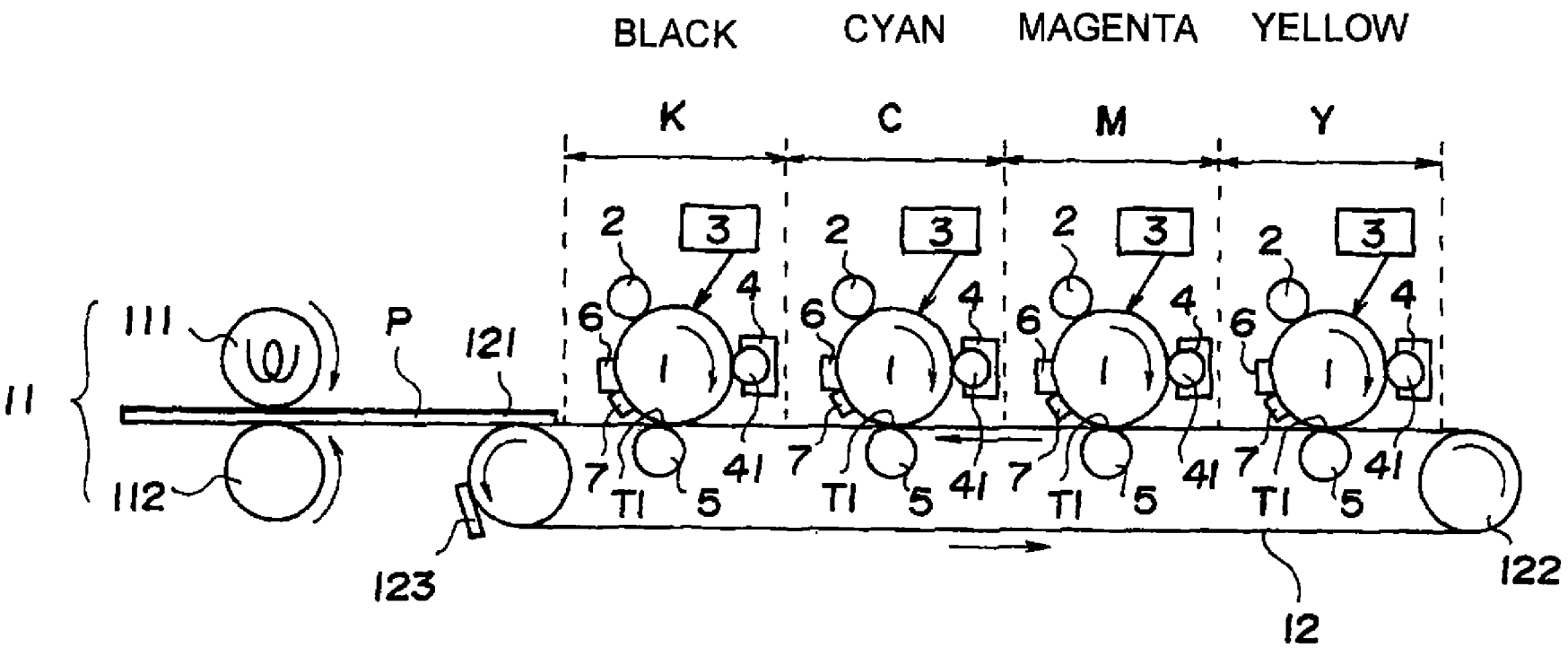
FIG. 6 is a longitudinal sectional view showing the schematic structure of an image forming apparatus of a third embodiment.
Figure 7:
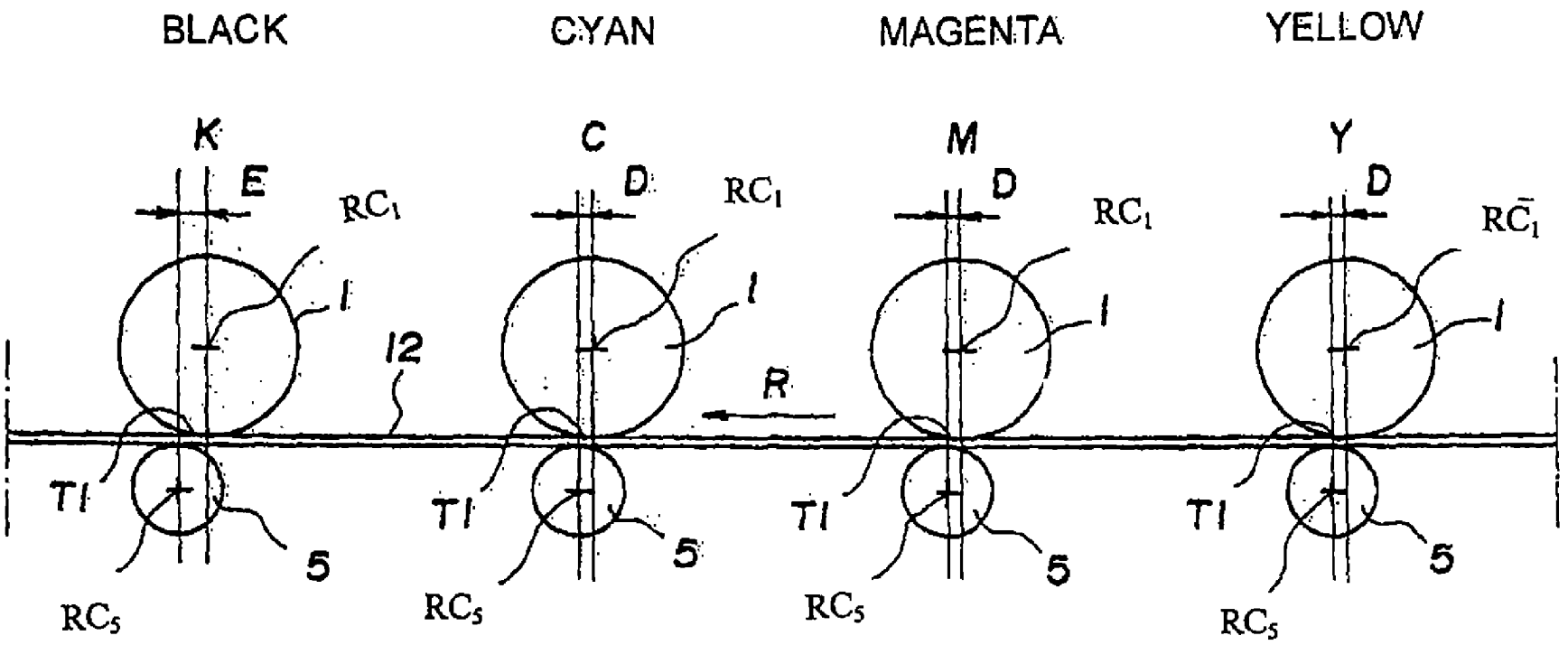
FIG. 7 is a schematic diagram showing the positional relation between a photosensitive member and a transfer roller of the third embodiment.

FIG. 6 is a schematic explanatory diagram of an image forming apparatus according to the third embodiment. FIG. 7 is a schematic explanatory diagram showing the positional relation between the photosensitive member 1 and the transfer roller 5 in the moving direction R of a transfer conveyance belt 12.

The above-described embodiment has exemplified the image forming apparatus in which a toner image on the photosensitive member 1 is transferred primarily to the intermediate transfer member 8 as a transfer object medium and the toner image is transferred secondarily to a recording material P. The image forming apparatus of this embodiment transfers a toner image formed on the photosensitive member 1 directly to the recording material P as the transfer object medium.

As shown in FIG. 6, the transfer conveyance belt 12 as a recording material conveyance means is stretched over a drive roller 121 and a driven roller 122 so as to oppose the respective image formation devices Y, M, C, K and rotatable in the direction of an arrow while kept in contact with the photosensitive member 1 of the image formation devices Y, M, C, K. In the meantime, the transfer conveyance belt 12 can be formed of resins such as polyester, fluorine resin, polyphenylene sulfide, polyamide imide, polyimide, polyether ketone, polycarbonate may be used. Preferably, the surface resistivity is $1\times10^{12}$-$1\times10^{15}$ Ω/□.

In this embodiment, an endless polyimide belt 75 μm in thickness whose surface resistance is adjusted to $1\times10^{13}$Ω/□ in volume resistivity according to a well known method is used. The electric resistance is measured in a condition of an applied voltage of 100 V and a charge time of 10 seconds using an R8340A measuring device manufactured by ADVAN TEST CORPORATION and a probe having a main electrode outer diameter of 50 mm and a guard electrode of 70 mm under an environment in which the temperature is 23° C. and the relative humidity is 50% RH.

In FIG. 6, reference numeral 123 denotes a transfer conveyance belt cleaning means, which removes fog toner, paper particles and the like on the transfer conveyance belt 12. For the transfer conveyance belt cleaning means 123, a cleaning roller, a cleaning blade, a cleaning web and the like may be used. This embodiment used a cleaning blade of polyurethane having 2 mm in thickness and a durometer A hardness of 75 and 2 mm in thickness.

The recording material P is absorbed electrostatically by the transfer conveyance belt 12 and conveyed to each of the image formation devices Y, M, C, K in which a toner image formed on each photosensitive member 1 is overlaid to the recording material P successively by applying a bias to the transfer roller 5 as a transfer member so as to form a color image.

The positional relation between the photosensitive member 1 and the transfer roller 5 in the magenta and cyan image formation devices M, C in such an image forming apparatus is as follows. The rotation center $RC_5$ of the transfer roller 5 is shifted (D in FIG. 7) downstream of the rotation center $RC_1$ of the photosensitive member 1 by 1.0 mm in the moving direction R of the transfer conveyance belt 12. As a consequence, the change in color by the inversely transferred toner is suppressed. In the meantime, the yellow image formation device Y is arranged in the same manner as the magenta, cyan image formation devices M, C. That is, the transfer roller 5 of the black image formation device K is disposed on the downstream side in the rotation direction of the photosensitive drum 1 with respect to the transfer roller 5 in the magenta, cyan, yellow image formation devices M, C, Y.

On the other hand, in the image formation device K having black having a small change in color, the rotation center $RC_5$ of the transfer roller 5 is shifted (E in FIG. 7) on the downstream side to the rotation center $RC_1$ of the photosensitive member 1 by 2.0 mm in the moving direction R of the transfer conveyance belt 12.

The position of the transfer roller 5 to the photosensitive member 1 in the image formation device K for black having the smallest change in color when toner of another color is mixed is set on the downstream side to the transfer roller 5 with respect to the photosensitive member 1 in the image formation device for the other colors. The arrangement of the transfer roller 5 in the image formation device K for black is compared with a case where the rotation center $RC_5$ of the transfer roller 5 is set on the downstream side of the rotation center $RC_1$ of the photosensitive member 1 by 1.5 mm like the image formation devices Y, M, C for the other colors. That is, the transfer roller 5 is disposed farther on the downstream side by 0.5-2.5 mm (2.0-4.0 mm to the photosensitive member 1). As a consequence, the change in color in an entire image is suppressed and the quality of black letter is improved, so that both are acceptable. It is assumed that a distance E between the rotation center $RC_1$ of the photosensitive member 1 of the black image formation device K and the center position of an area in which the transfer roller 5 and the transfer conveyance belt 12 make contact with each other in the moving direction of the transfer conveyance belt 12 in FIG. 7 is L1. Then, when it is assumed that a distance D between the rotation center $RC_1$ of the photosensitive member 1 of the cyan or magenta image formation device, C or M, respectively, and the center position of an area in which the transfer roller 5 and the transfer conveyance belt 8 make contact with each other is L2, it comes that 0.5 mm $L1-L2 \leqq 2.5$ mm.

A more preferable effect is secured when the transfer roller 5 is shifted on the downstream side by 1.0-2.0 mm (2.5-3.5 mm to the photosensitive member 1). That is, 0.5 mm $\leqq L1-L2 \leqq 2.5$ mm.

As a result of executing the same evaluation as the first embodiment in the above-described image forming apparatus, the same result as the first embodiment is secured so that the quality of black letters can be improved without worsening the change in color.

Other Embodiments

In the above-mentioned embodiments, the image forming apparatus using four color toners, yellow, magenta, cyan and black has been exemplified. Thus, the color having the smallest change in color due to mixing of colors of the four colors is black and the position of the transfer member in the black image formation device is shifted on the downstream side. However, the toner colors are not restricted to the above-mentioned four colors. In that case, even if other color toners are used, the position of the transfer member for a color having the smallest change in color upon mixing of colors with respect to the photosensitive member in the image formation device may be set on the downstream side with respect to the other image formation devices.

This application claims the benefit of priority from prior Japanese Patent Application No. 2005-263130 filed on Sep. 12, 2005 the entire contents of which are incorporated by reference herein.

What is claimed is:

1. A color image forming apparatus comprising:

a first development device which develops an electrostatic image on a first image bearing member with toner of color other than black so as to form a toner image and collects toner on the first image bearing member;

an image receiving member to which the toner image is transferred;

a first transfer member which forms a nip portion for nipping the image receiving member with the first image bearing member and transfers the toner image on the first image bearing member electrostatically to the image receiving member;

a second development device which develops an electrostatic image on a second image bearing member with black toner so as to form a toner image and collects the toner on the second image bearing member; and a second transfer member which forms a nip portion for nipping the image receiving member with the second image bearing member and transfers the toner image on the second image bearing member electrostatically to the image receiving member, wherein a first contact position where the first transfer member is contacting the image receiving member is on a downstream side relative to a position of a center of rotation of the first image bearing member in a moving direction of the image receiving member, wherein a second contact position where the second transfer member is contacting the image receiving member is on a downstream side relative to a position of a center of rotation of the second image bearing member in a moving direction of the image receiving member, and wherein a distance along the path of the image receiving member between a center of rotation of the second image bearing member and the second contact position is larger than a distance along the path of the image receiving member between a center of rotation of the first image bearing member and the first contact position.

2. The color image forming apparatus according to claim 1, wherein the second transfer member transfers the toner image on the second image bearing member to the image receiving member bearing the toner image transferred from the first image bearing member.

3. The color image forming apparatus according to claim 1, further comprising, a third development device which develops an electrostatic image on a third image bearing member with toner of color other than black so as to form a toner image and collects toner on the third image bearing member;

a third transfer member which forms a nip portion for nipping the image receiving member with the third image bearing member and transfers the toner image on the third image bearing member electrostatically to the image receiving member;

a fourth development device which develops an electrostatic image on a fourth image bearing member with toner of color other than black so as to form a toner image and collects toner on the fourth image bearing member; and a fourth transfer member which forms a nip portion for nipping the image receiving member with the fourth image bearing member and transfers the toner image on the fourth image bearing member electrostatically to the image receiving member;

wherein the second image bearing member is downstream in the moving direction of the image receiving member relative to each of the other development devices.

4. The color image forming apparatus according to claim 1, wherein the first image bearing member is a first rotatable photosensitive member, the first transfer member is rotatable, and a center of rotation of the first transfer member is downstream relative to a center of rotation of the first rotatable photosensitive member in the moving direction of the image receiving member.

5. The color image forming apparatus according to claim 4, wherein the second image bearing member is a second rotatable photosensitive member, the second transfer member is rotatable, and a center of rotation of the second transfer member is downstream relative to a center of rotation of the second rotatable photosensitive member in the moving direction of the image receiving member.

6. The color image forming apparatus according to claim 4, wherein the second image bearing member is a second rotatable photosensitive member, the second transfer member is rotatable, and a distance along the path of the image receiving member between the center of rotation of the second image bearing member and the center of rotation of the second transfer member is larger than a distance along the path of the image receiving member between a center of rotation of the first image bearing member and the center of rotation of the first transfer member.

7. A color image forming apparatus comprising:

a recording material conveying member to convey a recording material onto which a toner image is transferred;

a first development device which develops an electrostatic image on a first image bearing member with toner of color other than black so as to form a toner image and collect toner on the first image bearing member;

a first transfer member which forms a nip portion for nipping the recording material with the first image bearing member and transfers the toner image on the first image bearing member electrostatically to the recording material;

a second development device which develops an electrostatic image on a second image bearing member with black toner so as to form a toner image and collects the toner on the second image bearing member; and a second transfer member which forms a nip portion for nipping the recording material with the second image bearing member and transfers the toner image on the second image bearing member electrostatically to the recording material, wherein a first contact position where the first transfer member is contacting the recording material conveying member is on a downstream side relative to a position of a center of rotation of the first image bearing member in a moving direction of the recording material conveying member, wherein a second contact position where the second transfer member is contacting the recording material conveying member is on a downstream side relative to a position of a center of rotation of the second image bearing member in a moving direction of the recording material conveying member, and wherein a distance along the path of the recording material conveying member between a center of rotation of the second image bearing member and the second contact position is larger than a distance along the path of the recording material conveying member between a center of rotation of the first image bearing member and the first contact position.

8. The color image forming apparatus according to claim 7, wherein the second transfer member transfers the toner image on the second image bearing member to the recording material bearing the toner image transferred from the first image bearing member.

9. The color image forming apparatus according to claim 7, further comprising:

a third development device which develops an electrostatic image on a third image bearing member with toner of color other than black so as to form a toner image and collect toner on the third image bearing member;

a third transfer member which forms a nip portion for nipping the recording material with the third image bearing member and transfers the toner image on the third image bearing member electrostatically to the recording material;

a fourth development device which develops an electrostatic image on a fourth image bearing member with toner of color other than black so as to form a toner image and collect toner on the fourth image bearing member; and a fourth transfer member which forms a nip portion for nipping the recording material with the fourth image bearing member and transfers the toner image on the fourth image bearing member electrostatically to the recording material;

wherein the second image bearing member is downstream in the moving direction of the recording material relative to each of the other development devices.

10. The color image forming apparatus according to claim 7, wherein the first image bearing member is a first rotatable photosensitive member, the first transfer member is rotatable, and a center of rotation of the first transfer member is downstream relative to a center of rotation of the first rotatable photosensitive member in the moving direction of the recording material.

11. The color image forming apparatus according to claim 10, wherein the second image bearing member is a second rotatable photosensitive member, the second transfer member is rotatable, and a center of rotation of the second transfer member is downstream relative to a center of rotation of the second rotatable photosensitive member in the moving direction of the recording material.

12. The color image forming apparatus according to claim 10, wherein the second image bearing member is a second rotatable photosensitive member, the second transfer member is rotatable, a center of rotation of the second transfer roller is in a lower side relative to a center of the second image bearing member in the moving direction of the recording material conveying member, and a distance in the moving direction of the recording material conveying member between the center of rotation of the second image bearing member and the center of rotation of the second transfer member is larger than a distance in the moving direction of the recording material conveying member between a center of rotation of the first image bearing member and the center of rotation of the first transfer member.

* * * * *